US009635934B1

(12) United States Patent
Norton

(10) Patent No.: US 9,635,934 B1
(45) Date of Patent: May 2, 2017

(54) CLIP-ON PATTERN HOLDER WITH LAP-WORKSTATION

(71) Applicant: Donna Lynn Norton, Arkadelphia, AR (US)

(72) Inventor: Donna Lynn Norton, Arkadelphia, AR (US)

( * ) Notice: Subject to any disclaimer, the term of this patent is extended or adjusted under 35 U.S.C. 154(b) by 0 days.

(21) Appl. No.: 15/227,000

(22) Filed: Aug. 3, 2016

(51) Int. Cl.
*A47B 23/00* (2006.01)
*A47B 23/06* (2006.01)

(52) U.S. Cl.
CPC ..... *A47B 23/06* (2013.01); *A47B 23/002* (2013.01)

(58) Field of Classification Search
CPC ..... A47B 23/041; A47B 23/002; A47B 31/06
USPC ..... 108/43, 23, 25, 50.11, 50.01, 44, 45
See application file for complete search history.

(56) References Cited

U.S. PATENT DOCUMENTS 896,091 A * 8/1908 Doeserich ..... A47B 23/002 248/444
905,836 A * 12/1908 Bowman ..... A47B 19/04 108/43
3,730,077 A * 5/1973 Selden ..... A47B 23/00 108/43
4,052,944 A * 10/1977 Jennings ..... A47G 23/0608 108/43
4,243,249 A * 1/1981 Goss ..... B42F 9/001 108/43
4,312,507 A * 1/1982 Smith ..... A47B 23/001 108/23
4,537,646 A * 8/1985 Hoyle ..... B29C 63/04 156/212
4,700,634 A * 10/1987 Mills ..... A47B 23/002 108/43
5,460,102 A * 10/1995 Pasmanick ..... A47B 23/002 108/25
D372,903 S * 8/1996 Juster ..... D14/459
5,732,849 A * 3/1998 Brooks ..... A47G 23/0608 220/17.1
5,878,672 A * 3/1999 Ostermann ..... B60N 3/004 108/25
5,937,765 A * 8/1999 Stirling ..... A47B 23/002 108/43
5,979,337 A * 11/1999 Clark ..... A47B 23/06 108/23
6,041,715 A * 3/2000 Jarke ..... A47B 23/002 108/43
6,050,200 A * 4/2000 Sullins ..... A47B 23/002 108/25

(Continued)

*Primary Examiner* — Jose V Chen

(57) ABSTRACT

A detachable hardcopy support device attached to a reinforced lap pillow that contains a rigid sheet of foam board for strategically using as a connection platform for attaching the hardcopy support device to the reinforced lap pillow so that they may altogether function in a stable manner while being used in a user's lap, with the hardcopy support device being used for displaying fiber arts patterns, such as a knitting pattern, and with the lap pillow having a soft, cushioned, non-rigid, outer work surface on both the top and bottom sides for strategically using for long periods of non-irritating, comfortable contact with the user's skin, arms and legs while working in fiber arts, such as knitting, crochet, embroidery and cross-stitch for making hand-made items, and which altogether is best used while sitting in a reclined position with the footrest and the user's legs raised up to help prevent edema, is disclosed.

1 Claim, 3 Drawing Sheets

(56) References Cited

U.S. PATENT DOCUMENTS

| | | | | |
|---|---|---|---|---|
| 6,170,405 | B1 * | 1/2001 | Weitzman | A47B 3/083 108/174 |
| 7,275,724 | B1 * | 10/2007 | Ward | A47B 23/002 108/43 |
| 7,992,502 | B1 * | 8/2011 | Davis | A47B 23/04 108/43 |
| 8,104,733 | B2 * | 1/2012 | Skolnik | A47B 23/04 248/441.1 |
| 8,635,959 | B1 * | 1/2014 | Silknitter | A47G 23/0608 108/159.12 |
| 8,667,904 | B2 * | 3/2014 | Pajic | A47B 23/00 108/25 |
| 8,807,051 | B2 * | 8/2014 | Johnson | A47G 9/1045 108/25 |
| 9,003,978 | B1 * | 4/2015 | Fabricatore | A45C 11/00 108/43 |
| 2011/0056413 | A1 * | 3/2011 | Andochick | B42F 9/001 108/14 |

* cited by examiner

CLIP-ON PATTERN HOLDER WITH LAP-WORKSTATION

BACKGROUND OF THE INVENTION

Field of the Invention

The invention is useful for the field of fiber arts or crafts, and accessories for such.

Background Art

Adults or children who sit and work on fiber arts projects, such as knitting, crochet, embroidery or hand-sewing, in their lap, may struggle to follow a complex hardcopy pattern if not placed directly in front of their eyes. Either the pattern may be haphazardly placed on the same chair or seating area in which the user is sitting where it may fall off, or the pattern may be placed on a separate, nearby piece of furniture, either alone, or placed onto a holder, where the user would have to turn their head to the side to read and follow the pattern.

BRIEF SUMMARY OF THE INVENTION

A need exists for a stable, convenient and comfortable way to support and maintain a hardcopy pattern, such as a knitting pattern, while working on hand-made fiber arts projects for long periods of time, directly in both a user's lap and in front of their eyes, which is the focus of the invention. The invention is made up of a detachable hardcopy support device element that is placed in a user's lap by attaching it to the reinforced lap pillow element of the invention, which is also placed in a user's lap. The reinforced lap pillow element is reinforced by having a light-weight piece of foam board inserted inside the pillow which is surrounded by batting or cushioning material. The foam board piece becomes a solid attachment platform for accommodating the attachment of the two elements of the invention together so that they may strategically function as one device, thereby eliminating the need for a user to have to turn their head to the side to find their place on a hardcopy pattern as may be necessary when using older art. Furthermore, when a user works without the need for a pattern, the reinforced lap pillow may also be used without the detachable hardcopy device element to make hand-made projects. The built-in attachment platform located inside the reinforced lap pillow also provides the means for attaching other useful clip-on accessories that are not a part of the invention, such as a clip-on light for providing direct and excellent lighting, with it also being possible for such accessories to be used either alone, or at the same time as, the detachable hardcopy support device element of the invention. The invention is conveniently light and portable, and while it may be used in any seating area, the preferred type of seating area is a recliner used with the footrest and the user's legs raised up since this can help prevent edema while working for long periods of time. Since the detachable hardcopy support device element is made of ferromagnetic material, a flexible, movable magnetic strip may be used for following line-by-line the instructions of a complex hardcopy pattern. Also, the reinforced lap pillow is completely soft on all sides, thereby accommodating the user's skin, arms and legs for working without any time limitation in regard to causing any discomfort to the user. In conclusion, the invention not only solves deficiencies in the art, but also provides additional features and advantages for following a hardcopy pattern while working in one's lap. The advantages, features and other aspects of the invention will become more fully understood with reference to the following drawings, description and claim.

DETAILED DESCRIPTION OF THE INVENTION

Figure 1:
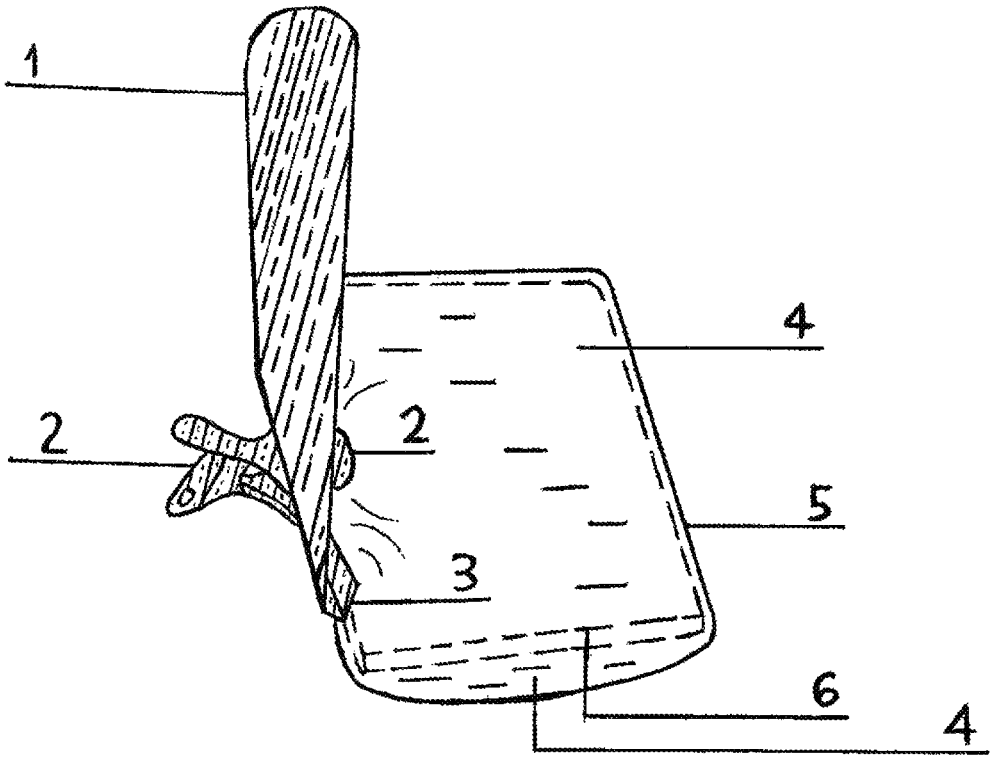
FIG. 1 is an illustration of the side view of the detachable hardcopy support device component attached to the reinforced lap pillow component.
Figure 2A:
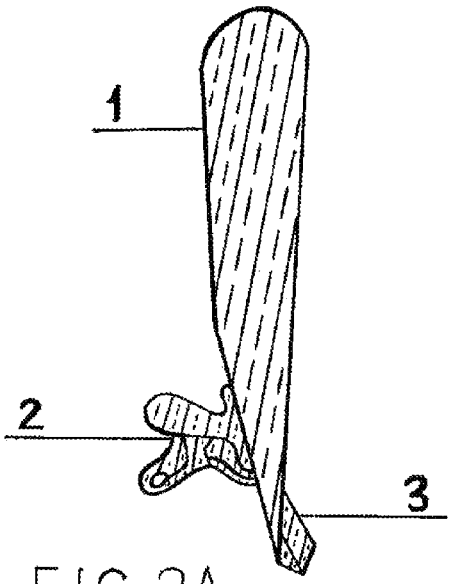
FIG. 2A is an illustration of the side view of the detachable hardcopy support device according to its embodiments.
Figure 2B:
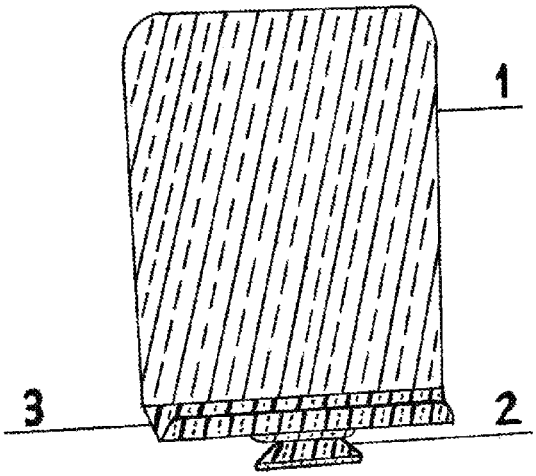
FIG. 2B is an illustration of the front view of the detachable hardcopy support device according to its embodiments.
Figure 2C:
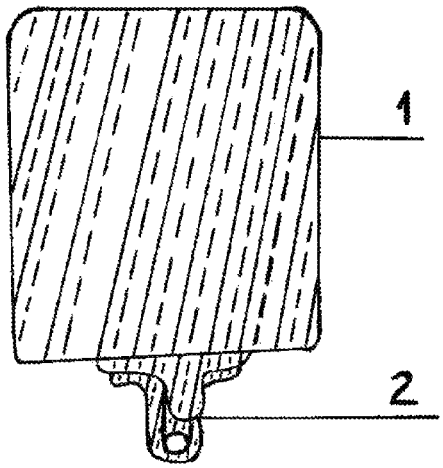
FIG. 2C is an illustration of the back view of the detachable hardcopy support device according to its embodiments.
Figure 3A:
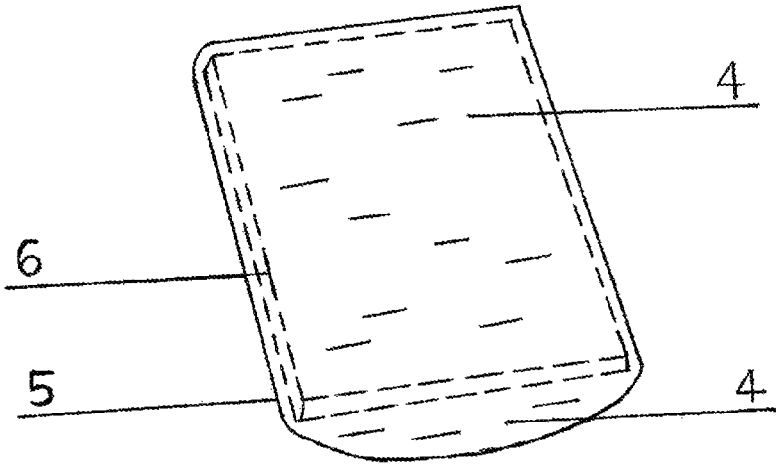
FIG. 3A is an illustration of the side view of the reinforced lap pillow according to its embodiments.
Figure 3B:
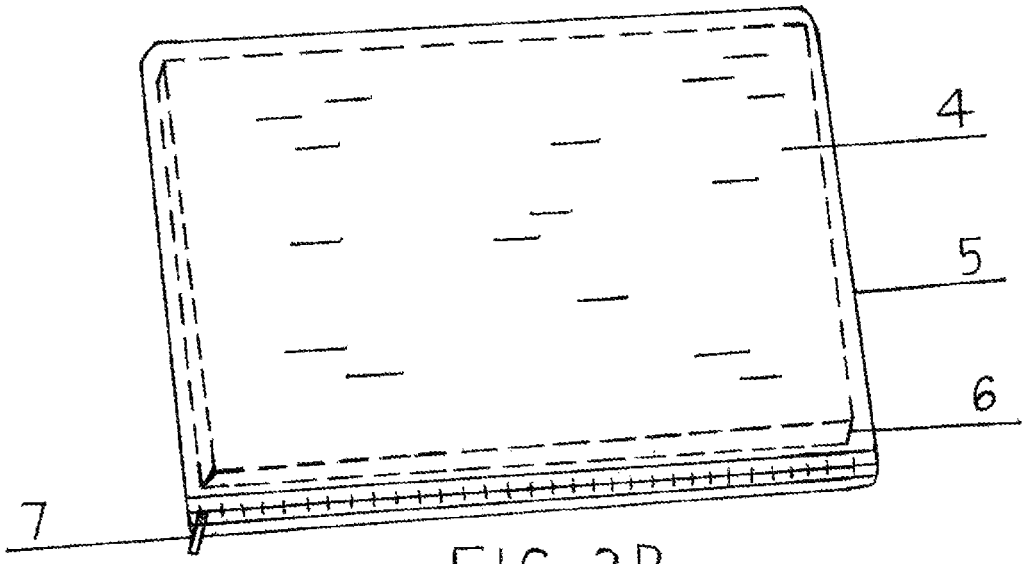
FIG. 3B is an illustration of the top view of the reinforced lap pillow according to its embodiments.

The following detailed description represents the best currently contemplated modes for carrying out the invention by hand-fabrication, and is not to be taken in a limiting sense, but is made merely for the purpose of illustrating the general principles of the invention. The following described fabrication processes should be performed using safety gloves and goggles where safety may be a concern. The invention includes a detachable hardcopy support device element, FIGS. 2A, 2B and 2C, and a reinforced lap pillow element, FIGS. 3A and 3B. Referring to FIGS. 2A, 2B and 2C, said detachable hardcopy support device is comprised of a flat metal panel 1 having across its entire bottom edge a shallow trough, 3 and, a fastening means 2 which is permanently affixed to, and under, said shallow trough 3 in the center area of the bottom edge of said shallow trough 3. Said metal panel 1 is made of suitable ferromagnetic material, such as flat sheet steel that is twenty-four gauge galvanized, bonderized steel which is commonly known as "paint grip steel" and which is paintable. Said metal panel 1 is cut from a flat sheet of said paint grip steel using a squaring shear tool, commonly known as aviation snips, to form a rectangular shape of a measurement that is approximately nine inches by ten and one-fourth inches, which is slightly shorter in height than hardcopy that may commonly be used for a pattern. The goal of having as little weight as possible was considered since less weight may translate into said fastening means 2 being able to function better mechanically for maintaining said detachable hardcopy support device in a stable viewing angle or position when supporting said detachable hardcopy support device in an upright, mainly vertical position while being attached to said reinforced lap pillow FIGS. 3A and 3B. Furthermore, said metal panel 1 is cut so that both top corners are rounded in shape. The edges of said metal panel 1 may be deburred and made smooth by using a suitable metal file or grinder. Said shallow trough 3 of said metal panel 1 may be created and formed using a metal bending apparatus called a sheet metal brake to angularly bend the entire bottom edge of said metal panel 1 approximately three-eighths of an inch upwards at a right-angle once, for forming the outer wall, or lip, for said shallow trough 3, and then again, for forming the base of said shallow trough 3, with said metal panel 1 forming the back wall of said shallow trough, 3 thereby giving said shallow trough 3 a depth of three-eighths of an inch, which when filled to capacity may hold approximately eighty sheets of paper, although in order to function as needed, should not be filled with more than approximately five sheets of paper while being used for supporting and following a hardcopy pattern with a magnetic strip, and furthermore, a writing utensil, such as a pen or pencil, or other useful small, light-weight items may also be held in the retaining area of said shallow trough 3 at the same time as hardcopy, with neither said writing utensil nor said other items being a part of the invention. After creating and forming said shallow trough, 3 the entire said metal panel 1 may be bent slightly backwards from the front of the entire said shallow trough 3 by approximately five degrees, thereby helping to prevent hardcopy from falling forward when placed into said shallow trough, 3 and which maintains said hardcopy at an angle which serves well for conveniently reading said hardcopy, especially while seated in a reclined position. The currently preferred contemplated embodiment to be used as said fastening means 2 is a large, readily available stainless steel binder clip commonly known as a "bulldog" clip. The preferred contemplated mode for permanently affixing said fastening means 2 to said shallow trough 3 of said metal panel 1 is to spot-weld the top of the jaw end of said fastening means 2 to the center area of the bottom edge of said shallow trough, 3 with an orientation such that the front edge at the end of said top of jaw end may line up evenly and flatly with the front outer edge of said shallow trough 3, thereby leaving the handle end of said fastening means 2 oriented in the direction toward the back of said metal panel 1. There may be four spot-welds approximately one inch apart, with half of said spot-welds placed on each side of the center of the welding or attachment area. Said spot-welds may be smoothed down using a metal file. Another acceptable means of permanently affixing said fastening means 2 to said shallow trough 3 may be to use a soldering method with a thorough amount of solder applied around the entire attachment area, but which may not be as fast, easy, clean, or as visually appealing as spot-welding. After said fastening means 2 has been permanently affixed to said detachable hardcopy support device, it may be completely masked off with masking tape and then said metal panel 1 and said shallow trough 3 may be spray-painted with suitable metal spray paint, and then after the spray paint is dry, the masking tape may be removed. Although prepainted steel material may seem to be practical, it would still have to be painted to match the color of the prepainted steel in the area where it would have to be prepared for attaching said fastening means 2 because it is not possible to spot-weld or solder steel material directly over paint, plus prepainted steel material may be twice as expensive as paint grip steel material and/or spray paint. Furthermore, it may be possible to invent and/or design different fastening means, such as a swing spine fastener, or such as a specialty hinge(s) like friction hinges used with laptop computers, or other suitable fastening means, however such contemplated other different fastening means may not even work as well, or may be more difficult and complicated, or may have other disadvantages that may not outweigh the advantages of using the currently preferred contemplated fastening means 2. A movable, flexible, strip of magnetic tape, which is not a part of the invention, may be placed over up to five sheets of hardcopy that is being maintained by said metal panel 1 for magnetically holding hardcopy against said metal panel, 1 and which conveniently facilitates marking one's place, and aids in, following a hardcopy pattern. Furthermore, should acrylic or plastic material be used for making said detachable hardcopy support device using a suitable method such as perhaps injection molding, perhaps a suitable fastening means may be designed into a mold so that said detachable hardcopy support device may be made as one piece instead of two separate but attached pieces, which may very well be possible, however a built-in sliding line marker may be desired to add to said detachable hardcopy support device as an aid for following a hardcopy pattern line-by-line, since plastic material is not magnetic, unless a sheet of suitable ferromagnetic material could perhaps be inserted and imbedded into said acrylic or plastic material, which may also very well be possible. Referring now to FIGS. 3A and 3B, the preferred contemplated measurements of said reinforced lap pillow when used by an adult may be approximately twelve inches by seventeen inches, which may be scaled down proportionately as needed for a child. Said reinforced lap pillow is comprised of a fabric enclosure 5 which encloses and contains conventional cushioning material, 4 such as batting, the purpose for which is to provide a cushioning effect, and said fabric enclosure 5 also contains a thin, light-weight, custom-cut, rigid sheet of foam board, 6 the purpose for which is to serve as a solid attachment platform whereby said detachable hardcopy support device FIGS. 2A, 2B and 2C may be attached to, or removed from, said reinforced lap pillow. Said cushioning material 4 may be bonded polyester batting of a quantity that will provide a moderate amount of cushioning loft of approximately one inch; and said cushioning material 4 is located inside said fabric enclosure 5 wherein it completely surrounds said sheet of foam board 6. In addition to serving as an attachment platform for said detachable hardcopy support device, FIGS. 2A, 2B and 2C said sheet of foam board 6 may also serve as an attachment platform for other useful clip-on type of accessories that are not a part of the invention, such as a clip-on light, which may be attached either alone, or at the same time as, said detachable hardcopy support device FIGS. 2A, 2B and 2C. Said sheet of foam board 6 may be constructed from foam board material of approximately three-eighths of an inch thick which may be cut with a utility knife after lining it up on a flat surface with a ruler for measuring as the preferred contemplated measurement of approximately a nine inch by fifteen inch rectangular configuration, the purpose for which is to fit fully inside of said fabric enclosure, 5 and which also thereby helps to facilitate uniformly smoothing out the work surface so that it does not readily crush or sink down as it might without such support. Said fabric enclosure 5 is made with cotton or other suitable fabric material, which, by using tailor scissors after it is lined up with a ruler on a flat surface, is cut as two identical pieces of fabric material that are approximately twelve and one-fourth inches by seventeen and one-fourth inches, thereby allowing for one-fourth of an inch seams for the construction of said fabric enclosure, 5 and which thereby forms the configuration of a rectangle having two shorter parallel sides and two longer parallel sides. The preferred contemplated mode for permanently joining the edges of said fabric material is by using a sewing machine. Said two identical pieces of fabric material may be placed one exactly on top of the other with right sides touching each other, and then may be temporarily pinned in place. Using said sewing machine with a presser foot, said edges of said fabric material may be permanently sewn on both of the shorter parallel sides and on one of the longer parallel sides, and then the other longer parallel side is used for sewing and installing a zipper 7 of an approximate length of sixteen inches, as an openable and closeable seam. Prepare for installing said zipper 7 by top-stitching a basting seam that will join said longer parallel sides together leaving approximately a one-fourth of an inch to one-half of an inch seam edge allowance, and then iron both flaps at the seam as flat and open. Place said fabric material and said zipper 7 onto a flat surface in a manner so that the teeth of the puller tab side of said zipper 7 line up with, and are touching, the ironed down basted seam on the wrong side of said fabric material. Using pieces of painter's tape, tape down the lined up said zipper 7 about every two inches perpendicularly across the entire length of said zipper 7. Using said sewing machine with a zipper foot, and with taped down zipper facing down and touching said sewing machine, and by feel, starting above and to the right of the head of said zipper, 7 and with the side of said zipper foot at the edge of the teeth of said zipper 7, top-stitch down the length of the zipper tape until reaching the end of said zipper teeth, and then pivot said fabric material, and then avoiding the metal stop piece, continue top-stitch sewing across the bottom of said zipper tape, and then pivot again at the opposite bottom corner, and then continue top-stitch sewing as described to sew down the other side of said zipper tape, stopping at the zipper head, and then remove said fabric material from said sewing machine. Remove said basting stitches using a seam ripper tool, and then remove said painter's tape by manually tearing it away carefully from the stitches, and then open said zipper 7 in order to be able to finish top stitching down past said metal stop on both sides of said zipper tape. Using tailor scissors, remove all loose thread ends. The purpose of said zipper 7 being approximately sixteen inches in length is to ensure matching as closely as possible to the length of said longer parallel side of said fabric enclosure, 5 which will thereby provide as much room as possible for accommodating ease of placing said sheet of foam board 6 and said cushioning material 4 inside said fabric enclosure, 5 and said sheet of foam board 6 may be inserted into the opened zippered side of said fabric enclosure 5 by matching the longer sides of both said fabric enclosure 5 and said foam board 6 together and then sliding the entire said sheet of foam board 6 straight into said fabric enclosure 5. The preferred contemplated mode of attachment of said detachable hardcopy support device FIGS. 2A, 2B and 2C to said reinforced lap pillow is to use the center area of the closed zippered side of said reinforced lap pillow for the attachment location, the purpose for which is so that said zipper 7 will thereby strategically not make contact with the user's body while using said reinforced lap pillow. While sitting down with said reinforced lap pillow placed in one's lap, if a user needs to use a hardcopy pattern, then with said detachable hardcopy support device FIGS. 2A, 2B and 2C in hand, said user may open said handle end of said fastening means, 2 FIGS. 2A and 2C and then attach said detachable hardcopy support device FIGS. 2A, 2B and 2C securely over the center area of the closed zippered side of said reinforced lap pillow, thereby orienting said fastening means 2 FIGS. 2A, 2B and 2C of said detachable hardcopy support device FIGS. 2A, 2B and 2C as far onto said sheet of foam board 6 as possible. A hardcopy pattern may then be placed into said shallow trough 3 FIGS. 2A and 2B of said detachable hardcopy support device, FIGS. 2A, 2B and 2C which may thereby orient a hardcopy pattern directly in front of a user's eyes.

I claim:

1. A detachable hardcopy support device attached to a reinforced lap pillow, the detachable hardcopy support device being characterized in that it is a flat, custom-cut rigid, metal panel made from a thin sheet of ferromagnetic steel that has a shallow trough-shaped member formed into, and across, its entire bottom edge so that said trough-shaped member has a front retaining wall, or lip, a base or bottom retaining section, and a back retaining wall, altogether which creates a trough-like receptacle for maintaining, supporting and displaying hardcopy, with said metal panel being angularly bent backwards slightly away from said trough-like receptacle to strategically further facilitate maintaining and reading hardcopy, and with said detachable hardcopy support device also being characterized in that it has a fastening device commonly known as a "bulldog" binder clip that is permanently affixed to the underside and in the center area of said bottom retaining section of said trough-shaped member, and with said fastening device having a gripping "jaw" end and a handle end, and with said fastening device used for attaching the entire said detachable hardcopy support device to said reinforced lap pillow, which is altogether strategically used in a user's lap for facilitating efficiently following a complex hardcopy pattern, such as a knitting pattern, and with said reinforced lap pillow being characterized in that it is a pillow having an outer cloth covering with a zippered side opening for encasing and retaining conventional soft cushioning material or batting that is located inside said pillow so as to give the entire outer top and bottom work surfaces of said pillow a soft, cushioned, non-rigid work surface as a strategy for being able to have long periods of comfortable contact with a user's skin, arms and legs, and with said batting surrounding another element inserted inside said pillow that is a thin, light-weight, custom cut, rigid sheet of foam board, also known as poster board that is custom-cut slightly smaller in total size than said cloth covering of said pillow, and with said sheet of foam board serving as a solid connection platform for attaching said detachable hardcopy support device to said reinforced lap pillow so that they may mechanically function together in a stable manner in a user's lap while sitting preferably in a reclined position so that the user's legs are raised up, thereby helping to prevent edema while working for long periods of time in the lap.

* * * * *